United States Patent [19]

Hillesland

[11] Patent Number: 4,643,585

[45] Date of Patent: Feb. 17, 1987

[54] LIGHT-FLASH STARTING SYSTEM

[76] Inventor: Gene G. Hillesland, 1580 Blountstown St. Apt. #41, Tallahassee, Fla. 32304

[21] Appl. No.: 844,386

[22] Filed: Mar. 26, 1986

[51] Int. Cl.[4] ..... G04F 8/00; G08B 23/00

[52] U.S. Cl. ..... 368/9; 368/10; 368/113; 340/323 R

[58] Field of Search ..... 368/3, 9, 10, 107, 110–113; 340/323 R, 600; 377/5, 53; 364/569

[56] References Cited

U.S. PATENT DOCUMENTS

| | | | |
|---|---|---|---|
| 3,739,368 | 6/1973 | Stalp | 340/323 |
| 3,795,907 | 3/1974 | Edwards | 377/5 |
| 3,829,869 | 8/1974 | Balko et al. | 354/109 |
| 4,074,117 | 2/1978 | De Lorean | 340/323 R |

*Primary Examiner*—Vit W. Miska

*Attorney, Agent, or Firm*—Erwin M. Barnett

[57] ABSTRACT

A light-flash starting accessory for the electronic clock of a photofinish and elapsed time recorder located at the finish line for timing a race for record establishing purposes comprising a starting gun, means for generating a light-flash simultaneously with the firing of said starting gun and located in relative close proximity to the starting line of said race, a flash finder located in the vicinity of said photofinish recorder and connected thereto by electronic cable, said flash finder being adapted for aiming at and sighting a designated mark for identifying the location of the source of said light-flash when emitted, said flash finder having means detecting said flash and generating an electronic pulse transmitted through said cable to start said electronic clock.

11 Claims, 3 Drawing Figures

LIGHT-FLASH STARTING SYSTEM

BACKGROUND OF THE INVENTION

1. Field of the Invention

This invention relates to a system for accurately timing athletic racing events, such as track meets, swimming meets and the like, for official record establishing purposes. The races to be timed are started by the firing of a starting gun and have a time sequence photographic record of the racing contestants at the finish line or at one or more intermediate timing lines, with visual indications of the elapsed time calibrated in the photograph with the images of the contestants, and, more particularly, is directed to a method and apparatus using a light-flash at the starting line and a light receptor and detector at the finish line for initiating the timer upon firing of the starting gun.

2. Description of the Prior Art

Accurate timing is required for any official recognition of running or swimming performances, and the timer must be started by automatic means. A photo finish record system currently in wide use and available under the trademark "Accutrack", produces a time sequence set of photographs of racing contestants crossing a line at which the contestants are timed in alignment with a numerical display of elapsed time expressed in hundredths of seconds. To start the "Accutrack" clock, a sound actuated switch, attached to the arm of the official race starter, was used with a wire conductor that extended from the starting line to a timing or finish line to signal the clock for starting the measurement of the elapsed time ultimately to be recorded on the photograph of the contestants crossing such line. Since the wire conductor had to be dragged to several different points on the track where the races started and finished during a single meet, this method has proved to be cumbersome and time consuming.

Another prior art method, eliminating the use of wire conductors and their attendant problems, has involved the use of radio frequency signals actuated by the sound of a starting gun. However, radio frequency interference causing spurious signals has been experienced when using radios to initiate the operation of the timer seriously affecting the reliability of the race records produced.

Sound actuation systems have also been proposed to initiate a timer. However, an extraneous sound may cause a false start of the timer. In addition, the finite speed of sound waves has a significant effect on the results recorded, particularly when times are measured to hundredths of seconds.

SUMMARY OF THE PRESENT INVENTION

The present invention eliminates the disadvantages of the hereinbefore mentioned prior art by providing an accessory for the "Accutrack" or similar device. The accessory generates a light flash at the starting line simultaneously with the firing of the starting gun and a light receptor and detector, hereinafter designated a flash finder, located in close proximity to the "Accutrack" and connected thereto by a cable. The flash finder is adapted for aiming at the location of the source of the light-flash when emitted and generating an electronic pulse, when such flash is detected, which is transmitted through said cable and starts the electronic clock to initiate measurement of the elapsed time of the race.

The flash finder also has a beeper which sounds simultaneously with the detection of the light-flash signaling the operator of the starting of the timer. The same beeper circuitry monitors the battery located in the "Accutrack" which powers both the latter and the flash finder circuitry, the beeper sounding to indicate and warn the operator of a low battery condition which otherwise might not become apparent until after a photograph is taken.

The light-flash generator may be a strobe light which is sound actuated by the firing of the starting gun or, as in a preferred form of the invention, the light-flash is generated by the explosive charge used in the cartridge in the gun. The explosive charge is a fine powered mixture including a metal, which rapidly oxidizes, when fired, producing an intense light-flash easily detectable by the flash finder.

DESCRIPTION OF THE PREFERRED EMBODIMENT

Figure 1:
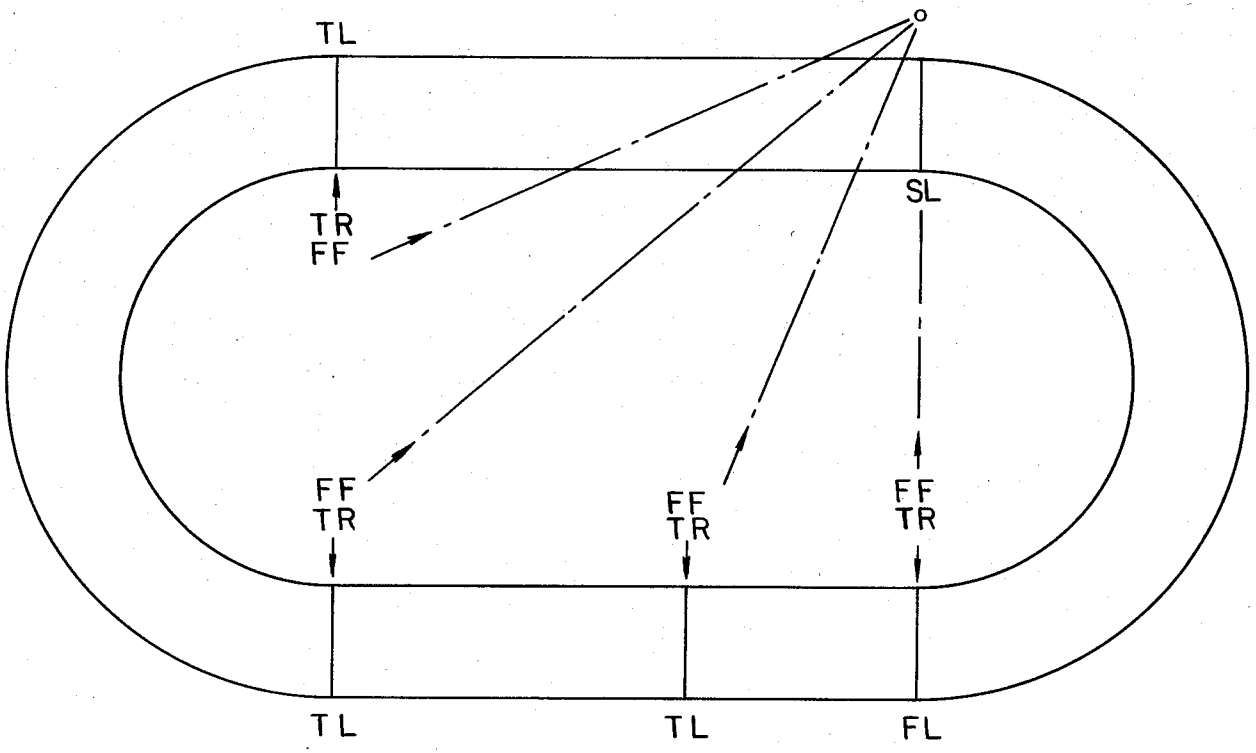
FIG. 1 is a diagrammatic plan view of a race track for track and field competition showing the relation of the starting gun at a starting line and a flash finder and time recording device in the vicinity of each of the timing lines and the finish line in an illustrative embodiment of the invention.

Referring to FIG. 1, the track is shown with a starting line SL, a finish line FL and a plurality of intermediate timing lines TL. In the vicinity of the starting line, a starter is provided with a starting gun capable of discharging a round of ammunition that flashes when discharged, or when using conventional ammunition, a sound actuated strobe light may be provided. A flash finder FF is provided in the vicinity of each timing line TL and in the vicinity of the finish line FL. Each flash finder FF is pointed in line of sight relation to a flash produced when the starting gun is discharged whereby the light rays emitted by the flash are detected. A time recording means TR is associated with each flash finder FF so that when the latter detects a flash produced by discharge of the starting gun, operation of its associated time recording device TR is initiated.

In the preferred embodiment of this invention, the time recording device TR is a component of the "Accutrack" which also comprises a camera sighted along each timing line TL and/or said finish line FL.

The "Accutrack" is substantially described in U.S. Pat. No. 3,829,869 to Balko et al which disclosure is incorporated herein by reference. The "Accutrack" photofinish record system produces a time sequence photograph of racing contestants crossing a timing line or finish line in alignment with a numerical display of elapsed time. The recording unit of Balko et al may be generally described as having a narrow aperture and a lens that focuses images within a narrow band including the finish line or timing line on a self-developing film.

The latter is carried for movement at constant speed past the lens by a film carriage driven on a linear track. A constant force spring motor acts on the carriage through a cable which is wound on a pulley pulled by a constant speed governor. The time recording device comprises an electronic clock driving a light emitting diode display producing visible numerical indications of elapsed time, which are projected onto one edge of the film. An automatic control cycle is provided whereby the unit is activated only when signalled by a photo electric sensor near the finish line. The interruption of a light beam by a contestant nearing the finish line causes the sensor to operate a switching circuit releasing a film advance latch, opening the camera shutter and turning on a lighted time display, all of which functions are either manually de-activated or automatically de-activated a predetermined time after restoration of the beam to the photo electric sensor, except that the cycle is retriggerable by another finishing contestant.

Figure 2:
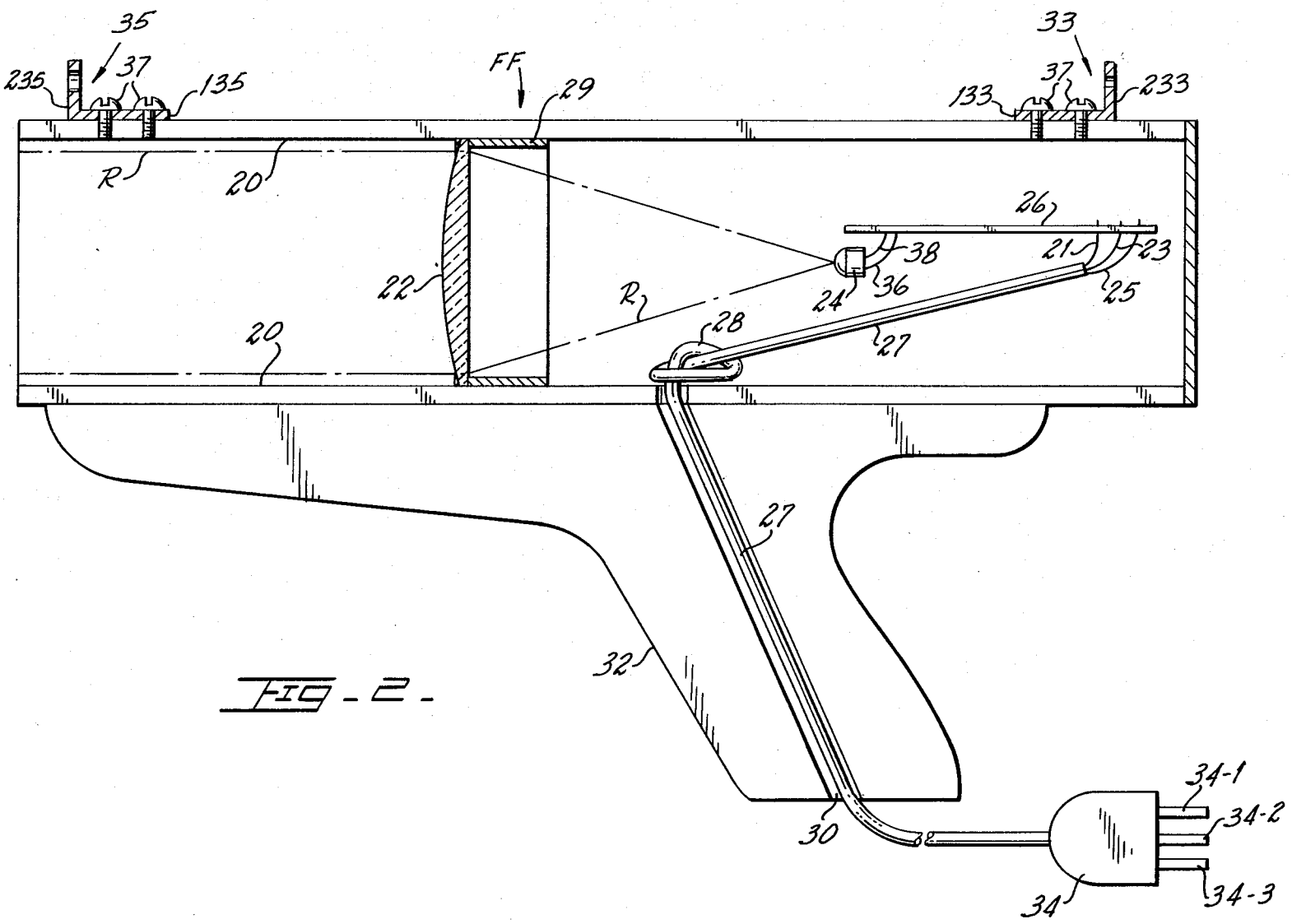
FIG. 2 is a longitudinal cross-sectional view of a light receptor and detector, namely, the flash finder embodying the invention, showing interior details.

As seen in FIG. 2, flash finder FF comprises an elongated barrel 20 mounted on handle 32 of pistol grip configuration and a rear and front sight 33 and 35, front sight 35 being located adjacent the open front, light receiving, end of barrel 20. A lens 22, photocell 24 and electronic circuit board 26 are mounted within barrel 20 and may be secured in position by any suitable means. The mounting of circuit board 26 is not shown, lens 22 being positioned with the periphery thereof abutting an interior locating sleeve 29 and may be secured to barrel 20 using a silicone rubber cement. Lens 22, which focuses light rays R on photocell 24, is located at a sufficient distance from the light receiving end of barrel 20 to be shielded from direct exposure to sunlight and other undesirable light rays when the barrel is sighted on the starting gun. In a preferred embodiment of the invention, wherein barrel 20 is approximately two inches in diameter and one foot in overall length, location of lens 22 about four inches from the light receiving end of barrel 20 achieves the desired shielding. Lens 22 has a diameter of 54 mm, and a focal length of 89 mm. The photocell 24 is shown suspended by its lead wires 36 and 38 from circuit board 26 and positioned at the focal point of lens 22 and is of the light sensitive transistor type, such as Radio Shack, Catalogue No. 276-130.

Whereas a lens system sight with or without telescopic capability may be suitably attached to barrel 20, the simple arrangement of rear sight 33 and front sight 35, attached in axially aligned relation to barrel 20, render satisfactory results. Each sight 33 and 35 is an angular member comprising a base plate 133 and 135, respectively, fixed onto the top of barrel 20, as by a pair of screws 37 for each sight, and an apertured flange 233 and 235 extending radially outward from base plate 133 and 135, respectively. The apertures of flanges 233 and 235 are aligned along an axis parallel with the longitudinal axis of barrel 20 insuring that the direct light rays from the starting gun, when sighted through said apertures, enter barrel 20 and are focused by lens 22 on photocell 24.

A triple lead wire cable 27 comprising lead wires 21, 23 and 25 has knot 28 in barrel 20 abutting the inner end of elongated passageway 30 in handle 32 for relieving tension on the solder connections at the circuit board 26. Cable 27, after extending through passageway 30 and emerging at the bottom end of handle 32, terminates in a three prong plug 34 having prongs 34-1, 34-2 and 34-3 connected to lead wires 21, 23 and 25, respectively. Plug 34 may be type A3M constructed to engage a companion three receptacle socket (not shown) provided in the "Accutrack".

Prong 34-2 being connected to the battery powering "Accutrack", supplies the 12 volt B+ power through lead wire 23 in cable 27 to terminal T2. B+ power is also supplied to terminals T4 and T5 by wiring not shown in the diagram. Lead wire 21, connecting to terminal T1 and through lead 21*a*, grounds circuit board 26 to the "Accutrack" ground, while lead wire 25, which through prong 34-2 connects to wiring from the "Accutrack" timer, terminates at terminal T3.

The clock of the "Accutrack" which measures and provides the elapsed time, which ultimately appears on the photograph for the official timing of the race, is started by the closing of a switch to reduce a predetermined voltage at the starting terminal on the clock from about 9.5 volts to the ground voltage. Flash finder FF provides such a switch in the form of transistor 50, a general purpose 2N2222A transistor, operating between T3, which in effect is an extension of the 9.5 volt terminal of the "Accutrack" clock, and ground terminal T1.

Figure 3:
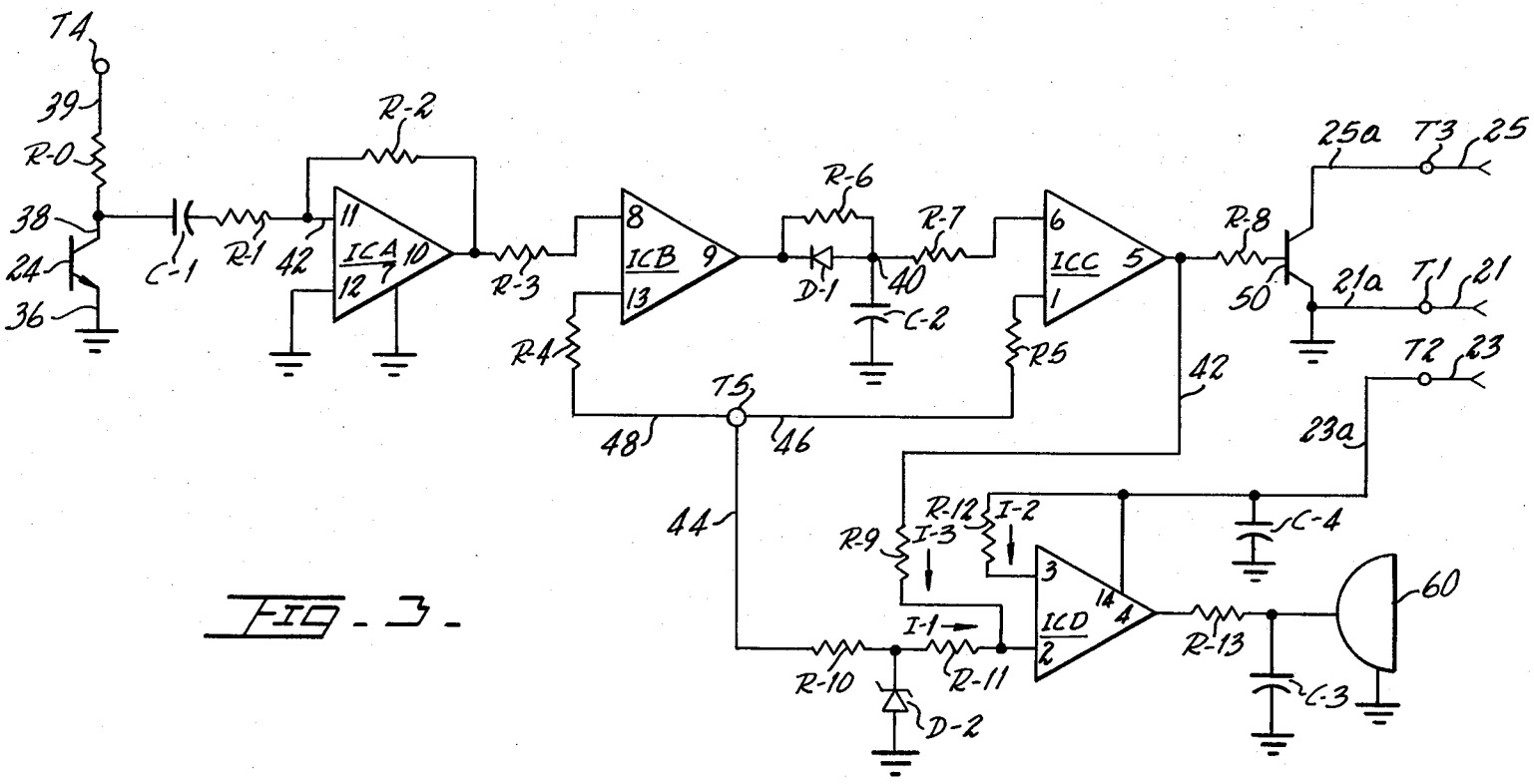
FIG. 3 is a schematic view of a preferred form of electrical circuit, the components of which are mounted on the circuit board located in the flash finder shown in FIG. 2 for performing the functions of light detection and simultaneous actuation of the time recording device and an audible signal device as embodied in the invention.

An integrated circuit, such as a Quad Norton Amplifier, LM 3900, along with resistor and capacitor components wired as shown in the schematic diagram in FIG. 3 and comprising circuits ICA, ICB, ICC and ICD provides the circuitry responsive to the lightflash generated at the starting line, when detected by photocell 24, and closes the transistor 50 switch thereby starting the elapsed time measuring clock of "Accutrack".

As seen in FIG. 3, pins 7 and 12 of circuit ICA are grounded and B+ power is supplied directly to pin 14 indicated on circuit ICD through line 23*a* and in required values from terminal T5 through resistors R-4 and R-5 in lines 48 and 46 to pins 13 and 1 of circuits ICB and ICC, respectively, and to pin 2 of circuit ICD through series resistors R-10 and R-11 in line 44, a 6 volts zener diode D-2 being used between resistors R-10 and R-11 and ground, for the purpose hereinafter described.

Lead wire 38 from the collector of photocell 24 connects to B+ terminal T4 through a 2.2K resistor in line 39 and is coupled to pin 11 of circuit ICA through 0.001 mfd. capacitor C-1 and a 10K resistor R-1, the emitter of photocell 24 being grounded through lead wire 36. A 1 megohm resistor R-2 provides a shunt between pins 11 and 10.

The light-flash from the starting line focused by lens 22 on photocell transistor 24 causes the latter to conduct and reduces the voltage across capacitor C-1 from the B+ of about 12 volts to a lesser voltage depending on the intensity of the light. The resulting voltage drop at pin 11 is amplified and inverted by circuit ICA, appearing as a positive going voltage at pin 10 with a gain of 100, which gain is determined by the ratio of R-2 to R-1.

Since circuits ICB, ICC, and ICD all can be considered to function as current comparators whereby whenever the current at each of the bottom pins 13, 1 and 2, as viewed in FIG. 3, is greater than the current at the respective upper pins 8, 6 and 3, the voltage at output pins 9, 5 and 4 is 12 volts. When the reverse exists output pins 9, 5 and 4 are at zero voltage.

Thus, circuit ICB serves as a threshold detector eliminating signals caused by extraneous light by providing a relatively high current of 12 $\mu$A at pin 13 as a reference flowing from the B+ at terminal T5 through the 1 megohm resistor R-4 in line 48, normally maintaining pin 9 at 12 volts. When the light-flash intensity reaches a predetermined value, the voltage rise at pin 10, being coupled by the 560 resistor R-3 to pin 8, causes current at pin 8 to exceed the 12 μA current at pin 13 and drops the voltage at pin 9 to zero. Substituting a 0.001 mfd capacitor for R-3 favors high frequency signals which has proved desirable.

The next stage uses circuit ICC to invert the zero signal at pin 9 to a 12 volt signal at pin 5 which drives transistor 50 into conduction thereby grounding terminal T3 and in turn grounding the clock starting terminal as hereinbefore described. An integrator network for lengthening the pulse generated by the light-flash and appearing at pin 9 as a negative going pulse of approximately 0.001 second to a negative going pulse of approximately 0.5 second, at pin 6 which is inverted to a positive going 0.5 second pulse of 12 volts at pin 5. The longer time is required primarily to produce a recognizable beep by beeper 60 as an audible signal to the operator that the flash was detected. The integrator network comprises resistors R-6 and R-7, diode D-1 and capacitor C-2 all connected at node 40.

Thus, at rest, pins 9 and 6 are at 12 volts and the 0.1 mfd. capacitor C-2 is fully charged to 12 volts. As pin 9 drops to zero volts, when the light-flash is detected, C-2 rapidly discharges through diode D-1 and then is slowly recharged through resistor R-6 by pin 9 which has returned to the 12 volt rest condition. In operating as a current comparator, circuit ICC maintains output pin 5 at zero when in rest condition, wherein the current at input pin 6 exceeds the relatively low reference current at pin 1, which is determined by the 10 megohm value of resistor R-5, the relatively greater current at pin 6 being determined by the normal 12 volts at pin 9 to which pin 6 is coupled by the pair of 3.9 megohm resistors R-6 and R-7. When the light-flash is detected, the resulting voltage drop at pin 9 reduces the current at pin 6 to a value below pin 1 causing output pin 5 to go to 12 volts. This condition is maintained during the time capacitor C-2 is recharging, this time, namely, 0.5 second, being determined by the time constant relation between diode D-1 and resistor R-6.

To sound beeper 60 during the 0.5 second inteval that pin 5 is at 12 volts, current comparator circuit ICD maintains output pin 4 at zero by a normal current I-1 at pin 2 of about 15.4 μA flowing through the 390K resistor R-11, zener diode D-2 serving to maintain 6 volts at the junction between resistors R-10 and R-11. The I-2 current at pin 3 is greater than the I-1 current at pin 2, I-2 current having a value of 17.7 μA derived from the 12 volt B+ at terminal T2 flowing through 680K resistor R-9. When pin 5 goes to 12 volts the current I-1 normally at pin 2 is added to by current I-3 flowing through a 680 resistor R-9 in line 42 between pin 5 and pin 2. The latter now having a total current of about 33 μA clearly exceeds the current at pin 3. Circuit ICD now provides 12 volts at pin 4 which connects to beeper 60 by a 100 ohm resistor. Thus, beeper 60 sounds for the 0.5 second inteval until pin 5, returning to zero and discontinuing current I-3, likewise restores the zero volt, rest, condition to pin 4.

Inasmuch as a low battery voltage has been found to affect the operation of the "Accutrack" camera, the circuitry associated with circuit ICD is provided to also monitor this battery voltage which appears at T2. Since any change in B+ voltage at T2 is reflected in the value of currect I-2 at pin 3, a drop in B+ below a threshold value of 10.5 volts will correspondingly lower the current I-2 below the I-1 current of 15.4 μA at pin 2. This condition will raise the voltage at output pin 4 and sound beeper 60 to alert the operator. This audible signal will be continuous and readily distinguishable from the 0.5 second signal generated by the light-flash.

Capacitors C-3 and C-4 serve as filters. Also, a 0.01 mfd capacitor (not shown) may connect B+ terminal T3 to ground to eliminate undesirable oscillation. A suitable relay may be substituted for transistor 50 to perform the switch closing function of starting the clock.

A feature of the invention is the provision of cartridges enabling the starting shot to simultaneously provide the light-flash for detection by the flash finder FF. The conventional race-starting pistol made with a solid barrel is sufficiently vented so that a light-flash generated by the explosive charge will be clearly visible at a distance.

The invention, therefor, contemplates a novel explosive formulation as a charge for the cartridge which may include a mixture of quick burning gum powder and flash producing powdered magnesium in which the latter constitutes 10% to 20% by weight. A preferred formulation utilizes aluminum as the light-flash producing metal mixed with an oxidizing agent.

Specifically, an example of a preferred formulation, which renders optimum results, comprises a finely powdered aluminum of 425 mesh mixed with powdered barium nitrate in approximately a 50-50 proportion by weight. Each cartridge, which uses a standard primer, may be charged with about 60 mg, more or less, of the mixture, appropriately retained therein. This preferred formulation burns almost instantaneously in an intense flash, is very clean, leaving little or no residue either in the gun or on the hands of the starter, produces a shot having a noise level approximating that of the acceptable level of the conventional starting gun, and is relatively low in cost.

The light-flashes produced by these mixtures are easily detected by flash finder FF at ranges in excess of ¼ mile. As the maximum range required for track events is 150 yards, the embodiment of the accessory featuring this flash producing powder provides a comfortable margin of reliability.

It is contemplated that when using the strobe light as the flash generator that a sound actuated switch for firing the strobe be provided in close proximity and the strobe pointed in the direction of the finish line FL.

In order to be more easily recognized by the operator holding flash finder FF at the finish line FL, the starter may wear a luminescent article made of a "dayglo" material, such as a glove, sleeve or cap, although a simple wrist band has proved to be satisfactory.

To summarize the operation of the accessory embodying the invention, plug 34 having been connected to the appropriate socket of the "Accutrack" located at the finish line FL, the operator, holding the flash finder FF by handle 32 sights the starter at starting line SL through sights 33 and 35. When the gun loaded with a cartridge charged with the light flashing mixture fires to signal the starting of the race, the light flash generated simultaneously therewith, enters barrel 20 and is focused by lens 22 on photocell 24 and causes the latter to conduct. This drops the voltage at pin 11 to a negligible value and circuit ICA amplifies and inverts the signal at pin 10 to a positive value. Circuit ICB compares the currect at pin 8, which reflects that at pin 10, to a reference at pin 13. When the current at pin 8 exceeds that at pin 13, circuit ICB drives pin 9 to zero and the integrator network beyond pin 9 serves to increase the pulse to 0.5 second which appears at pin 6. Circuit ICC inverts this 0.5 second pulse to a positive pulse at pin 5, which ultimately through transistor 50 and the circuit ICD to beeper 60, closes the clock starting switch and audibly signals this successful detection of the starting flash to the operator.

It is to be understood that within the scope of this invention, flash finder FF and its associated components, herein described, may be adapted to start the electric clock of photofinish and elapsed time recorders other than "Accutrack".

The light-flash starting accessories for photofinish record systems herein disclosed are seen to achieve the several objects of the invention and to be well adapted to meet conditions of practical use. As various possible embodiments might be made of this invention, and as various changes might be made in the disclosed accessories, it is to be understood that all matters herein set forth or shown in the accompanying drawings are to be interpreted as illustrative and not in a limiting sense.

What is claimed is:

1. A light-flash starting accessory for the electronic clock of a photofinish and elapsed time recorder located at the finish line for timing a race for record establishing purposes comprising a starting gun, means for generating a light-flash simultaneously with the firing of said starting gun and located in relative close proximity to the starting line of said race, a flash finder located in the vicinity of said photofinish recorder and connected thereto by electronic cable, said flash finder being adapted for aiming at and sighting a designated mark for identifying the location of the source of said light-flash when emitted, said flash finder having means detecting said flash and generating an electronic pulse transmitted through said cable to start said electronic clock.

2. The accessory defined in claim 1 in which said light-flash generating means is the starting gun loaded with a cartridge containing an explosive charge, the latter including a finely powdered metal which rapidly oxidizes to produce said light-flash when the gun is fired.

3. The accessory defined in claim 2 in which said explosive charge comprises a mixture of powdered barium nitrate and said powdered metal, the latter being aluminum.

4. The accessory defined in claim 3 in which said powdered barium nitrate and powdered aluminum are in equal proportions by weight.

5. The accessory defined in claim 4 in which said explosive charge is approximately 60 mg.

6. The accessory defined in claim 3 in which said aluminum powder is of 425 mesh.

7. The accessory defined in claim 2 in which said explosive charge comprises a mixture of quick burning gun powder and said powdered metal, the latter being magnesium.

8. The accessory defined in claim 7 in which said powdered magnesium comprises between 10% and 20% of the mixture.

9. The accessory defined in claim 1 in which said light-flash generating means is a strobe light.

10. The accessory defined in claim 1 in which said flash finder includes an audible signaling device actuated by said electronic pulse to signal detection of the light-flash.

11. The accessory defined in claim 1 in which said recorder is powered by a battery and said flash finder is powered by the same battery, said electronic pulse generating means including means for monitoring the battery voltage.

* * * * *